US006657385B2

(12) United States Patent
Tomasetti et al.

(10) Patent No.: US 6,657,385 B2
(45) Date of Patent: Dec. 2, 2003

(54) DIAMOND TRANSMISSION DYNODE AND PHOTOMULTIPLIER OR IMAGING DEVICE USING SAME

(75) Inventors: Charles M. Tomasetti, Leola, PA (US); Robert Caracciolo, Lancaster, PA (US); Charles B. Beetz, Southbury, CT (US); David R. Winn, Westport, CT (US)

(73) Assignee: Burle Technologies, Inc., Wilmington, DE (US)

( * ) Notice: Subject to any disclaimer, the term of this patent is extended or adjusted under 35 U.S.C. 154(b) by 0 days.

(21) Appl. No.: 09/885,716

(22) Filed: Jun. 20, 2001

(65) Prior Publication Data

US 2002/0041154 A1 Apr. 11, 2002

Related U.S. Application Data

(60) Provisional application No. 60/212,498, filed on Jun. 20, 2000.

(51) Int. Cl.[7] ..... H01J 40/16

(52) U.S. Cl. ..... 313/527; 313/373; 313/377; 313/379; 313/385; 313/528; 313/530; 313/541; 313/544

(58) Field of Search ..... 313/527, 365, 313/373, 377, 379, 384, 385, 386, 387, 528, 529, 530, 532, 533, 540, 541, 542, 543, 544, 103 R, 103 CM, 105 R, 105 CM; 250/207, 214 VT

(56) References Cited

U.S. PATENT DOCUMENTS 5,471,051 A * 11/1995 Nigaki et al. ..... 250/214
5,587,210 A 12/1996 Marchywka et al.
5,592,053 A * 1/1997 Fox et al. ..... 315/3
5,680,008 A 10/1997 Brandes et al.
5,891,575 A 4/1999 Marchywka et al.
5,986,387 A 11/1999 Niigaki et al.
5,990,484 A * 11/1999 Ohsuka ..... 250/458.1

OTHER PUBLICATIONS

G.T. Mearini et al., "Investigation of Diamond Films for Electronic Devices," Surface and Interface Analysis, vol. 21, 138–143 (1994).

G.T. Mearini et al., "Fabrication of an electron multiplier utilizing diamond films," Thin Solid Films 253 (1994) 151–156.

D.S. Burgess, "Researchers Unlock the Secrets of Diamonds," Photonics Spectra, Apr. 2000.

W.J. Zhang et al., "(001)–textured growth of diamond films on polycrystalline diamond sub–strates by bias–assisted chemical vapor deposition," J. of Crys. Growth 171 (1997) 485–492.

X. Jiang et al., "Effects of ion bombardment on the nucleation and growth of diamond films," Physical Review B, vol. 58, vol. 58, No. 11, pp 7064–7075, (Sep. 1998).

I.P. Csorba, "Modulation transfer function of image tube lenses," Applied Optics, vol. 16, No. 10, pp 2647–2650 (Oct. 1977).

G. Vergara et al., "Escape probability for negative electron affinity photocathodes: calculations compared to experiments," SPIE, vol. 2550, pp. 142–156.

(List continued on next page.)

*Primary Examiner*—Ashok Patel
(74) *Attorney, Agent, or Firm*—Dann, Dorfman, Herrell and Skillman, P.C.

(57) ABSTRACT

A diamond transmission dynode and photocathode are described which include a thin layer of a crystalline semiconductive material. The semiconductive material is preferably textured with a (100) orientation. Metallic electrodes are formed on the input and output surfaces of the semiconductive material so that a bias potential can be applied to enhance electron transport through the semiconductive material. An imaging device and a photomultiplier utilizing the aforesaid transmission dynode and/or photocathode are also described.

48 Claims, 7 Drawing Sheets

OTHER PUBLICATIONS

X. Zhang et al., "Oriented growth of a diamond film on Si(100) by hot filament chemical vapor deposition," Journal of Crystal Growth 155 (1995) 66–69.

P. Lerner et al., "Hot electron and quasiballistic transport of nonequilibrium electrons in diamond thin films," J. Vac. Sci. Technol. B 15(2) pp 398–400 (Mar./Apr. 1997).

P.H. Cutler et al., "Monte Carlo study of hot electron and ballistic transport in diamond: Low electric field region," J. Vac. Sci. Technol. B 14(3), pp 2020–2023 (May/Jun. 1996).

M. Niigaki et al., "Electron diffusion length and escape probabilities for cesiated and hydrogenated polycrystalline diamond photocathodes," Applied Physics Letters, vol. 75, No. 22, pp 3533–3535 (Nov. 1999).

S.H. Kim et al., "Effect of the cyclic growth/etching time ratio on the {100}–oriented texture growth of a diamond film," Thin Solid Films 290–291 (1996) 161–164.

J.W. Lee et al., "Cyclic technique for the enhancement of highly oriented diamond film growth," Thin Solid Films 303 (1997) 264–268.

S.T. Lee et al., "A Nucleation Site Mechanism Leading to Epitaxial Growth of Diamond Films," Science Magazine, vol. 287, No. 5450, pp 104–106 (Jan. 2000).

M. Albrecht et al., "Diamond nucleation under bias conditions," J. Appl. Phys. 83 (1), pp 531–539 (Jan. 1998).

S.T. Lee et al., "CVD diamond films: nucleation and growth," Materials Science and Engineering, R25, No. 4, pp 123–154 (Jul. 1999).

G.R. Brandes, "Work function and affinity changes associated with the structure of hydrogen terminated diamond (100) surfaces," Physical Rev. B, vol. 58, No. 8, pp 4952–4962 (Aug. 1998).

V.I. Polyakov et al., "Effects of post–growth treatment and coating with ultrathin metal layers on the band bending and field electron emission of diamond films," J. Appl. Phys., vol. 84, No. 5, pp 2882–2889 (Sep. 1998).

M.A. Plano et al., "Polycrystalline CVD Diamond Films With High Electrical Mobility," Science 260, 1310 (1993).

"Statistical Theory of Noise in Photomultiplier Tubes," Photomultiplier Handbook, p 167 (1980).

* cited by examiner

DIAMOND TRANSMISSION DYNODE AND PHOTOMULTIPLIER OR IMAGING DEVICE USING SAME

This application claims the benefit of priority from U.S. Provisional Application Ser. No. 60/212,498, filed Jun. 20, 2000.

FIELD OF THE INVENTION

This invention relates to thin film transmission dynodes, and in particular to a method of producing such dynodes. The invention also relates to a photomultiplier or imaging device incorporating such a thin film dynode.

BACKGROUND OF THE INVENTION

In a thin film transmission dynode, secondary electrons are generated by impacting one side of the film with incident electrons. The energy of the incident electrons is adjusted such that the incident electron beam penetrates nearly through the thin film dynode material. This requires high accelerating voltages for the incident electrons and very thin film structures of materials that have small or negative electron affinity. The known thin film transmission dynodes are usually less than 100 nm in thickness and are quite fragile. Consequently, they require special methods for preparation and mounting when used in photoelectronic devices.

FIG. 1 is a schematic diagram of a known thin-film diamond transmission dynode 10. As shown in FIG. 1, a beam of incident electrons 12 is directed toward the incident surface 14 of the thin diamond film 10. The incident electrons 12 traverse the diamond material and produce secondary electrons 16 within the film 10. Some of the secondary electrons 18 are able to diffuse to the opposite surface 19 where they can escape into a vacuum because of the low or negative electron affinity of the diamond surface. However, the process of electron transmission in the known diamond thin film dynode is undesirably inefficient because of scattering losses which limit the diffusion length of the electrons to short distances. The very short electron diffusion lengths mandate that the dynode be limited to not more than about 100 nm thick.

SUMMARY OF THE INVENTION

In accordance with one aspect of the invention described herein, there is provided an electron multiplying transmission dynode for a photoelectronic device. The transmission dynode includes a layer of semiconductive material having an input surface and an output surface. A first metallic electrode is formed on the input surface of the semiconductive layer and a second metallic electrode is formed on the output surface of said semiconductive layer. The semiconductive material preferably has a crystalline structure that is textured with a (100) orientation.

In accordance with another aspect of this invention there is provided a photocathode for emitting photoelectrons in response to incident light. The photocathode includes a layer of semiconductive material having an input surface and an output surface. A first metallic electrode is formed on the input surface of the semiconductive layer and a second metallic electrode is formed on the output surface of the semiconductive layer. As in the case of the transmission dynode, the semiconductive material preferably has a crystalline structure that is textured with a (100) orientation.

In accordance with a further aspect of this invention there is provided an optical imaging device. The optical imaging device includes a photocathode, an electron multiplying transmission dynode having input and output surfaces, and a phosphor screen disposed for receiving electrons emitted from the output surface of said electron multiplying transmission dynode. The electron multiplying transmission dynode has a thin layer of a semiconductive material. A first metallic electrode is formed on the input surface and a second metallic electrode is formed on the output surface. The electron multiplying transmission dynode is disposed for receiving electrons from the photocathode at the input surface. The optical imaging device also includes a source of electric potential operatively connected to the first and second metallic electrodes, means for spacing the electron multiplying transmission dynode from the photocathode, and means for spacing the phosphor screen from the output surface.

In accordance with a still further aspect of this invention there is provided a photomultiplier having a photocathode, an electron multiplying transmission dynode, and an anode for receiving electrons emitted from the electron multiplying transmission dynode. The electron multiplying transmission dynode includes a thin layer of a semiconductive material having an input surface and an output surface. A first metallic electrode is formed on the input surface and a second metallic electrode is formed on the output surface. The electron multiplying transmission dynode is disposed for receiving electrons from the photocathode at the input surface. The photomultiplier also includes a source of electric potential operatively connected to the first and second metallic electrodes, means for spacing the electron multiplying transmission dynode from said photocathode, and means for spacing the anode from the electron multiplying transmission dynode.

BRIEF DESCRIPTION OF THE DRAWINGS

Further novel features and advantages of the present invention will become apparent from the following detailed description and the accompanying drawings in which.

DETAILED DESCRIPTION

Transmission Dynode

The present invention overcomes the disadvantages of the known thin film transmission dynodes. The transmission dynodes prepared according to this invention can be substantially thicker and have higher yields of secondary electrons than the known thin film transmission dynodes.

Figure 1:
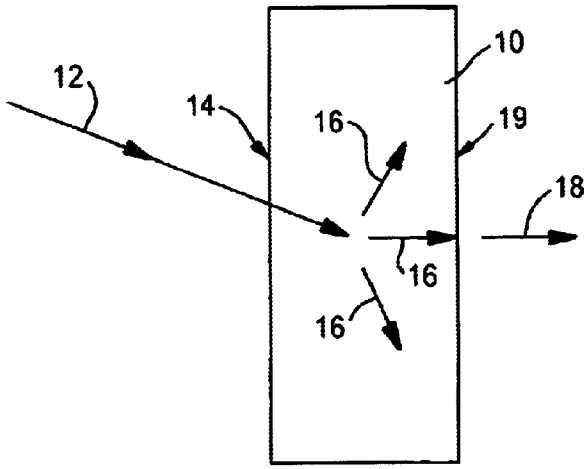
FIG. 1 is a schematic diagram of a known thin-film diamond transmission dynode.
Figure 2:
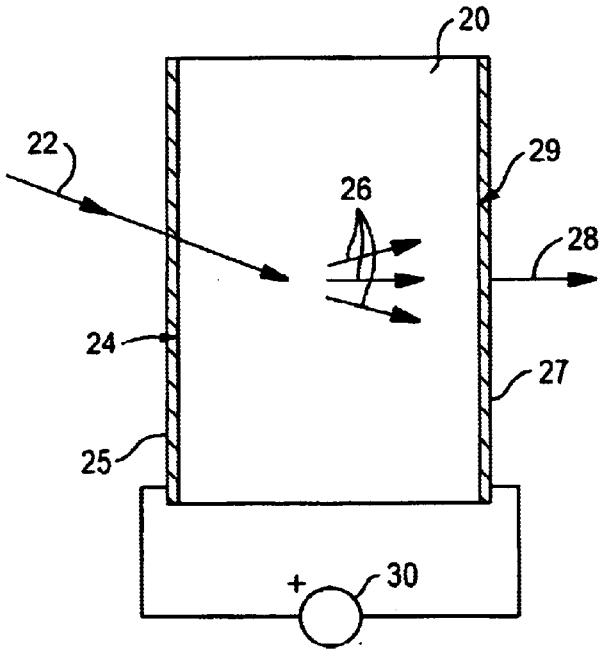
FIG. 2 is a schematic diagram of a diamond transmission dynode in accordance with the present invention.
Figure 3:
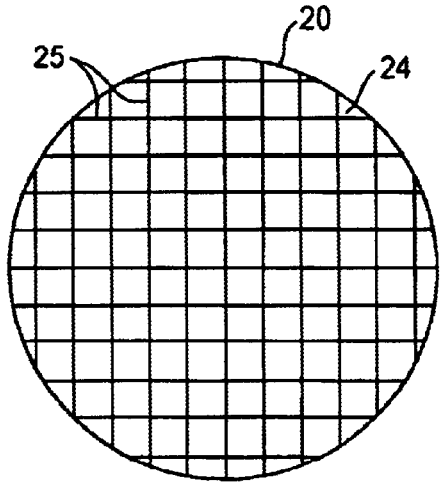
FIG. 3 is an end view of the diamond transmission dynode of FIG. 2.

Shown in FIG. 2 is a diamond film dynode 20 in accordance with the present invention. The dynode 20 is constructed from a diamond film and electrodes 25, 27 are deposited on each side of the film. The electrodes 25, 27 are preferably in the form of an open grid, as shown in FIG. 3. The material for the electrodes is chosen to make good ohmic contact to the diamond film. Suitable materials include Ti, Ni, or Mo. Referring back to FIG. 2, a bias potential 30 can be applied to the electrodes 25, 27 which sets up an electric field in the diamond film 20. When an electron beam 22 is incident on a surface 24 of the diamond film dynode 20, secondary electrons 26 are produced in the film. The secondary electrons 26 are accelerated towards the opposite surface 29 by the electric field and escape into a vacuum space. Because of the quasiballistic nature of the electron transport, the diffusive length can be over an order of magnitude larger than obtained with the known diamond thin film dynode. That capability enables the use of thicker diamond films and improves the yield of secondary electrons that make it out of the film.

The invention takes advantage of two unique properties of diamond and similar semiconducting materials. First, the surfaces of the thin film can be prepared with very small or negative electron affinity (NEA). Second, carriers can be transported within the thin film materials by a quasiballistic transport mechanism with lower scattering losses than achieved with the known thin film dynode materials. The transmission dynode structure according to the present invention utilizes the unique quasiballistic transport properties of polycrystalline diamond films to accelerate secondary electrons produced within the bulk of the diamond material toward the surface opposite that on which the electrons are incident. Electrodes formed on each face of the dynode are energized to accelerate the secondary electrons out of the polycrystalline diamond material into vacuum. The electrons are transported with low losses through the bulk of the diamond material and are emitted into vacuum through a surface that is processed to provide a small or negative electron affinity. Preferably, the incident face of the transmission dynode is processed to minimize reflection secondary emission of electrons therefrom.

Quasiballistic propagation of electrons in diamond is characterized by the transfer of a substantial portion of the field energy to the electrons. In this regard, up to about 50% energy transfer is possible for electric fields up to about 100V/$\mu$m and film thicknesses of about 0.4 $\mu$m at electron concentrations of about $10^{18}/cm^3$. At lower electron concentrations the quasiballistic transport can be extended up to several micrometers. It is this feature of the present invention that enables thicker transmission dynodes to be used. Moreover, the quasiballistic electrons emerge from the diamond film with substantial energy. When an applied field of 100 V/$\mu$m is used, the average electron energy has been found to be about 7 eV for a 1 $\mu$m thick film, and the maximum energy has been found to be about 30 eV. These electrons are emitted into vacuum with vanishingly small transverse momentum, which significantly reduces the electron optics required for focusing or steering the electrons along desired trajectories.

Figure 4:
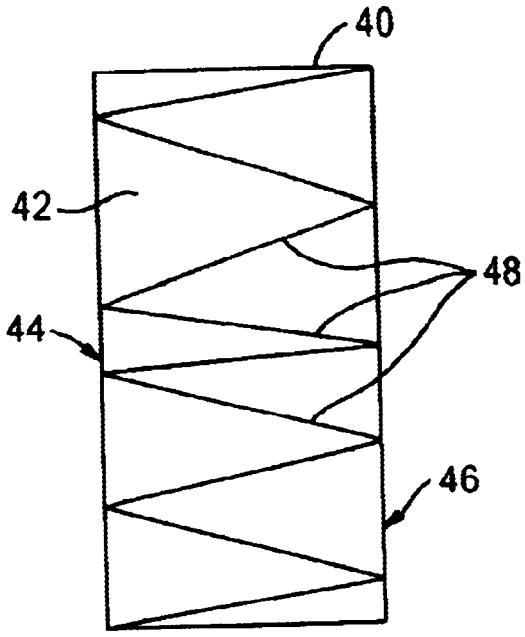
FIG. 4 is a schematic diagram of the grain boundary geometry for a randomly oriented polycrystalline diamond film.
Figure 5:
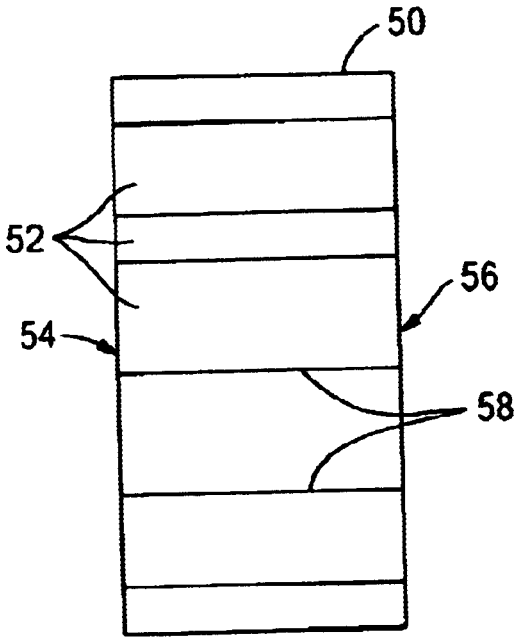
FIG. 5 is a schematic diagram of the grain boundary geometry for a (100) textured polycrystalline diamond film in accordance with the present invention.

Another feature of the diamond dynode according to this invention is the use of highly textured, (100)-oriented polycrystalline diamond films for the dynode. The use of highly (100) textured diamond films minimizes interference with electron transport by grain boundary regions that are typically present in non-textured polycrystalline diamond films. This concept is illustrated in FIGS. 4 and 5. FIG. 4 shows a schematic diagram of a non-textured, randomly oriented diamond film 40. FIG. 5 shows a (100) textured polycrystalline diamond film 50. In the non-textured diamond film 40, as secondary electrons diffuse across the randomly oriented crystal grains 42, grain boundaries 48 must be crossed because of the tapered growth-cone morphology of the polycrystalline grains in the diamond film 40. The grain boundaries 48 act as scattering sites which attenuate the internally generated secondary electrons, thereby reducing the yield of electrons out of the film on the exit side. In the case of the (100) textured film 50 shown in FIG. 5, the grains 52 are not tapered, or at least have minimal taper, and the grain boundaries 58 rarely intercept an electron. Therefore, scattering losses are significantly reduced and the yield of secondary electrons out of the (100) textured film 50 is significantly greater than for the non-textured film. The use of these highly textured films with a (100) preferred orientation could also improve the secondary electron yield of a traditional thin film diamond transmission dynode because of the reduced number of scattering sites. Another advantage of the highly (100) textured film according to the present invention is that the surfaces 54, 56 have predominantly (100) faces which are more easily processed to a state of negative electron affinity. This is a significant advantage because a surface with NEA enables the secondary electrons to escape more easily from the solid material into a vacuum.

Figure 6:
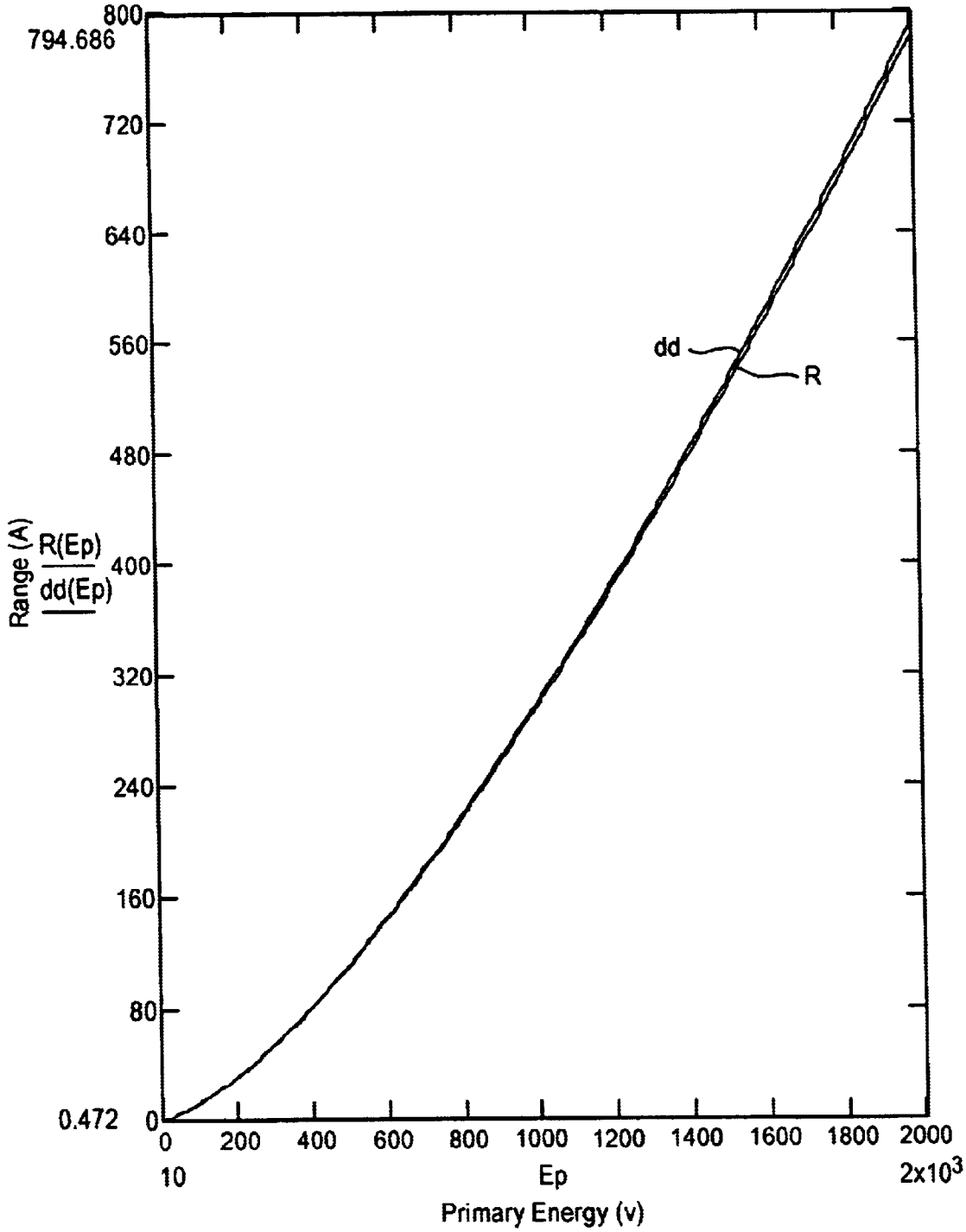
FIG. 6 is a graph showing the range of incident electrons into a diamond film as a function of the energy of the incident electrons.
Figure 7:
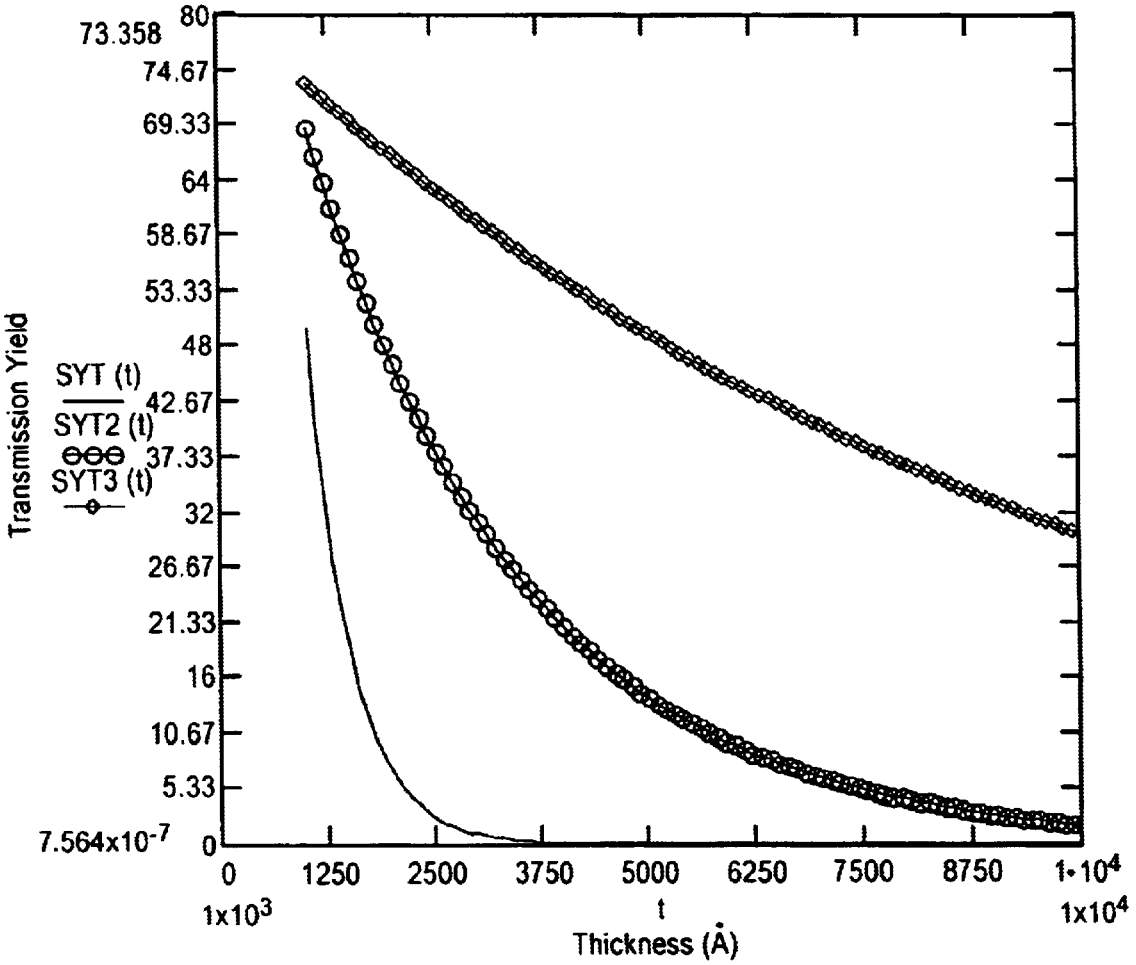
FIG. 7 is a graph of the transmission yield of secondary electrons into a vacuum as a function of the thickness (d) of a diamond film for an incident electron having an energy of 2000V, wherein the solid line represents d=50 nm, the circles (○) represent d=250 nm, and the diamonds (◇) represent d=1 $\mu$m.

The electron diffusion length for randomly oriented polycrystalline diamond films has been estimated at approximately 50 nm and the escape probability for a cesiated, randomly oriented polycrystalline diamond film surface is about 0.8. Using those numbers, the transmission secondary electron yield can be estimated for the case of a thin film. FIG. 6 shows a graph of the penetration depths of electrons as a function of the energy of the incident electrons. Electrons incident at about 2000 V penetrate to a depth of about 80 nm in diamond film. A graph of the yield of secondary electrons from the exit side of a diamond film is shown in FIG. 7 for an incident electron having an energy of 2000 V. The transmission yield is given by the Equation (1) below.

$$SYT(V)=B\times SYR(V)\times e^{(R-i)/D}$$

where SYT(V) is the secondary electron yield in transmission as a function of the incident electron energy in volts, B is a known constant, SYR(V) is the secondary electron yield in reflection, R is the range of the incident electron beam, t is the thickness of the transmission dynode, and D is the length of diffusion of electrons in the film. The secondary electron yield in reflection of a cesiated diamond surface for electrons incident at 2000 V has been measured as SYR (2000)≈100. The transmission yield at a thickness of 100 nm is about 50, while at 500 nm, it is about 1. Those calculations assume an escape probability of 0.8 and a diffusive length of about 50 nm, which is typical of randomly oriented, polycrystalline diamond films. The graph of FIG. 7 also shows the case where the diamond film has a highly preferred orientation so that the grain boundary scattering is greatly reduced. Under those conditions the diffusive length can be as large as about 250 nm. In such case, the electron yield at a thickness of 100 nm is about 70, and the electron yield at a thickness of 500 nm is about 14. Diffusive lengths exceeding 1 $\mu$m have been reported in polycrystalline CVD (chemical vapor deposition) diamond films. Such a diffusive length would substantially increase the electron yield to about 30 at a thickness of 1000 nm and to about 50 at 500 nm thickness as shown in FIG. 7. If ballistic transport is employed, the yield will only be slightly attenuated up to thicknesses on the order of a few micrometers, extending the thickness of the transmission dynode substantially. The increase in thickness up to 1 $\mu$m is important because it gives the dynode robust mechanical properties that are important for handling the dynodes and for resistance to damage from mechanical shock and/or vibration. The electrons emitted into vacuum need to be replaced which requires surface electrodes for injecting electrons back into the diamond material.

The transmission secondary emission (TSE) dynode of the present invention is preferably formed of polycrystalline diamond. However, other crystalline semiconductor materials may be used including $CaF_2$, MgO, AlN, BN, GaN, InN, SiC, and nitride alloys including two or more of Al, B, Ga, and In. Single crystal structures of any of the foregoing materials may also be used when desired.

A thin film, polycrystalline diamond TSE dynode in accordance this invention has at least two features that are novel and important for producing the desired high electron yield diamond transmission dynode structures. First, the diamond material is preferably textured with a (100) orientation. Second, the transmission dynode has electrodes applied to the incident and emission surfaces thereof to permit secondary electrons produced in the diamond film to be transported quasiballistically through the film with very little loss. The first of these features enables much higher electron yields for thin transmission dynodes compared to known thin film transmission dynodes made from randomly oriented polycrystalline diamond films. The second feature permits thicker, i.e., more robust, dynodes to be readily fabricated while maintaining the secondary electron yield high enough to satisfy the requirements for photomultiplier tubes and imaging devices.

The following examples illustrate methods for fabrication of a transmission dynode according to this invention.

EXAMPLE 1

A diamond film is grown epitaxially on a (100) textured Si wafer employing a bias enhanced cyclic growth technique to produce a highly (100) oriented crystallographic texturing of the diamond film. The growth technique employs a nucleation step together with various etching time intervals. In this process, a Si wafer is cleaned and placed in a microwave plasma enhanced chemical vapor deposition (CVD) reactor. The Si wafer is placed on a Mo substrate holder so that a bias voltage can be applied. The Si wafer is exposed to a hydrogen plasma for about 10 minutes with the bias voltage set at 0 V. Following the hydrogen plasma treatment, the Si wafer is subjected to a carburization reaction by heating to 860° C. and applying 900 W of microwave power in a gas mixture consisting of 2% methane in hydrogen at a pressure of 20 torr. These conditions are maintained for 2 hours. Next the nucleation stage is started by adjusting the bias voltage to about 200 V maintaining the temperature and plasma power constant as in the carburizing step.

The next step is a cyclic growth/etch process during which the gas mixture is changed from 2% methane in hydrogen to substantially pure hydrogen at a total pressure of 20 torr. The cyclic conditions are 30 second nucleations in the gas mixture (2% $CH_4$ in $H_2$) and 30 seconds of etching in the pure $H_2$. This cyclic process is continued for about 5 to 10 minutes. At the end of the growth/etch step the film growth is continued by maintaining the gas mixture (2% $CH_4$ in $H_2$) at 25 torr, decreasing the substrate temperature to 700° C., and increasing the microwave power to 1000 W. The film growth is continued until the desired film thickness is reached.

Other film-growth techniques that result in highly textured (100)-oriented diamond films are known to those skilled in the art. A comprehensive review of diamond film growth techniques is given in Lee et al., "CVD Diamond Films: Nucleation and Growth", *Materials Science and Engineering,* R25, No. 4, pp. 123–154 (July 1999). Following film growth the Si wafer is patterned and windows exposing the diamond film are created employing well known processing techniques. At this point the diamond film is exposed to an oxygen plasma for several minutes to produce a monolayer of oxygen-terminated carbon atoms on the diamond surface. Next a fine metal grid is produced on both surfaces of the diamond to enable biasing the film for extraction of secondary electrons from the dynode.

A number of such dynodes may be arranged in a stack with suitable insulating layers in between for isolating the voltage applied to each dynode. After the stack is mounted within a vacuum enclosure and evacuated, the diamond film surfaces need to be exposed to a small pressure of cesium to create a dipole layer on the surface for reducing the electron affinity making it favorable for electrons to escape from the film into vacuum. This stack forms a complete transmission dynode whose gain (G) is proportional to the transmission secondary yield ($\delta$) raised to the power which is the number of stages (N) in the dynode, i.e., $G \approx \delta^N$. The transmission dynode can be mounted in an enclosure between an appropriately situated photocathode and an anode. The enclosure is then evacuated to form a photomultiplier tube, for example.

EXAMPLE 2

The thin film diamond TSE dynode can be implemented using either natural or synthetic single crystal (100)-oriented diamond for the transmission dynode. Single crystal (100)-oriented substrates can be made by the so-called lift-off technique. That process has the advantage that there are very few grains in the film and therefore scattering losses from such grains are substantially eliminated. In this process a single crystal diamond substrate is implanted with an ion such as carbon to a depth of about 0.5 to 1.0 $\mu$to provide a damaged layer of non-diamond carbon below the top surface of the substrate. An epitaxial diamond film is then grown on the implanted surface until the desired thickness is achieved, e.g., about 1.0 to 3.0 $\mu$m. The damaged implant layer is then removed using an electrochemical process leaving free-standing diamond plate. The plate is metallized on its front and back surfaces with thin square-grid electrodes. The purpose of the electrodes is to facilitate the application of an electric field for accelerating the secondary electrons produced inside the film by the incident electrons. This dynode could be incorporated into a stack of transmission dynodes as described in Example 1, or used in conjunction with other multiplying elements such as microchannel plates or channeltrons.

EXAMPLE 3

This example is similar to Example 1 except the surface of the diamond film is treated with a hydrogen plasma to give a completely hydrogen terminated negative electron affinity surface.

EXAMPLE 4

This example is also similar to Example 1 except that the diamond film is covered with a monolayer or less of a metal selected from the group consisting of Ti, Ni, Cu, and Zr to provide a low or negative electron affinity surface.

EXAMPLE 5

This example is similar to Example 2 except that the electrodes applied to the diamond are made by implanting a lithium layer at about 34 keV at 200° C. and a fluence about $4(10)^{16}/cm^2$ below the diamond surface, and contacting the implanted surfaces.

EXAMPLE 6

This example is also similar to Example 2 only the diamond film is doped with approximately $10^{18}/cm^3$ nitrogen atoms.

EXAMPLE 7

A $CaF_2$ single crystal film is grown on (100)-oriented Si substrate. Windows are formed in the Si substrate using standard processing techniques to expose the $CaF_2$ film and make a transmission dynode. The surfaces of the $CaF_2$ film are metallized as described for Example 1 to complete the dynode fabrication. The dynode can be incorporated in a phototube similar to that described in Example 1. $CaF_2$ exhibits a negative electron affinity of a few tenths of an eV, similar to diamond. $CaF_2$ also can be grown with an epitaxial relationship to the Si surface resulting in a single crystalline film that has few grain boundaries.

In the preparation of a semiconductive TSE dynode according to the present invention, the open grid electrode on the input side of the thin film could be replaced with a continuous, thin, metallized layer. The purpose of such a layer is to minimize reflection secondary emission of electrons at the incident surface of the diamond thin film TSE dynode. In such an arrangement, it is understood that a grid-type electrode is used on the output surface, as described above.

The methods for making the diamond transmission dynode according to this invention can also be utilized to make a photocathode with improved sensitivity. For example, a photocathode made in accordance with the present invention would have the sensitivity of a thin diamond layer, CaF, GaN, or alloys of GaN. CaF has particular sensitivity in the deep ultraviolet region of the spectrum. The energy gap varies with composition for the GaN alloys. For example, the energy gap in eV for $In_xGa_{1-x}N$ is calculated as $E_g(x)=3.5-2.63x+1.02x^2$. For the alloy $Al_xGa_{1-x}N$, in eV is calculated as $E_g(x)=E_{gAlN}+(1-x)E_{g,GaN}-bx(1-x)$. In this case, $b=1.0\pm0.3$, $E_{gAlN}=3.4$ eV, and $E_{g,GaN}=6.2$ eV.

Following is an example of the preparation of such a diamond transmission photocathode.

EXAMPLE 8

A silicon wafer is initially coated with a silicon nitride film. The silicon nitride film is patterned in areas where the diamond photocathode is to be deposited. The silicon nitride is removed from the patterned areas leaving a bare silicon surface for diamond film growth. A p-type doped diamond film is grown on a silicon wafer (100) using growth techniques that lead to (100) preferred oriented film. Following diamond film growth, the silicon nitride film is removed from the corresponding areas on the backside of the silicon. The size of the back side opening must be on the order of 20% smaller in area than the front side opening. The Si substrate is removed from the open area in the nitride to form a freestanding diamond membrane. The diamond membrane forms the transmission photocathode covering the opening. The front side and back side of the wafer are sequentially patterned with photoresist so that a metal film contact can be deposited using a lift-off technique on each side that contacts the diamond film at its edges to enable a bias voltage to be applied across the diamond film and the photocurrent to be replaced.

The material for the metal film contact is chosen to make a good ohmic contact to the p-type diamond film. Suitable metals include Ti, Ni, or Mo, for example. Following lift-off patterning, the diamond and substrate are exposed to a source of atomic hydrogen to etch the diamond film surface and to fully hydrogenate the diamond surface. At this point the diamond film will exhibit a negative electron affinity.

In operation, the metal film contact, which is preferably in the form an open grid, is connected to a source of electrical potential. When a small bias voltage is applied to the diamond film surface opposite to the incident light, photogenerated carriers are accelerated toward the exit side of the film and out into the vacuum of the tube or other device. As an alternative preparation technique, after hydrogen etching, the diamond film can be exposed to a source of atomic oxygen to oxygenate the diamond surface. After the diamond film is mounted into a vacuum enclosure, it is then exposed to a monolayer coverage of cesium to form a robust negative electron affinity surface.

Imaging Device

Figure 8:
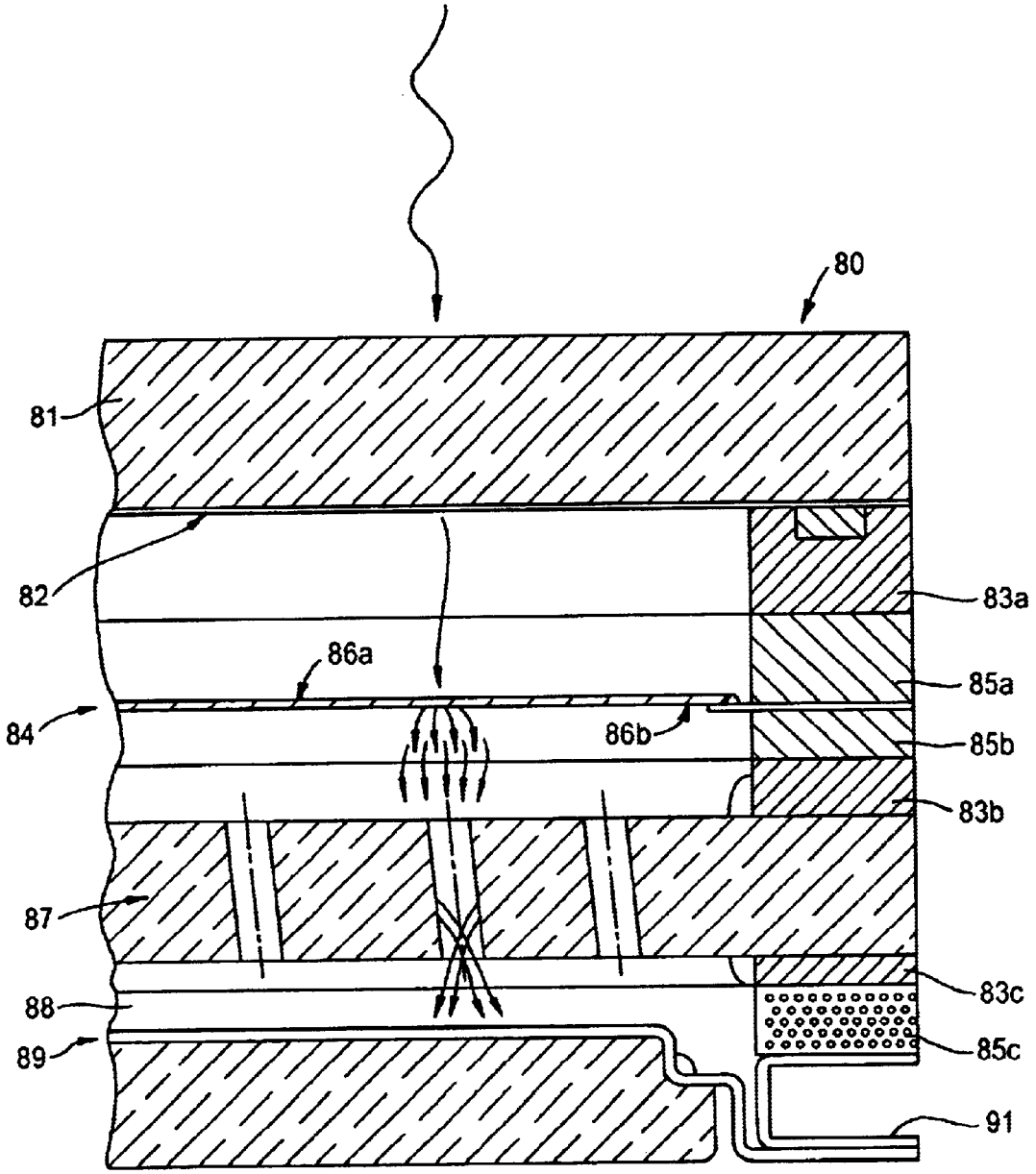
FIG. 8 is a partial cross-sectional view of an image intensifier in accordance with the present invention.

Referring now to FIG. 8, there is shown, in partial cross section, an optical imaging device 80 in accordance with another aspect of the present invention. The imaging device 80 includes a glass face plate 81 and a photocathode 82 formed on a surface of the face plate 81 and spaced a small distance from a TSE diamond thin film dynode 84 as described in the previous section. A metallic spacer 83*a* and a ceramic spacer 85*a* are disposed between the photocathode 82 and the diamond film dynode 84. The spacing between the photocathode and the diamond thin film dynode is selected to provide sufficient acceleration of primary photoelectrons emitted by the photocathode to impinge upon a first surface 86*a* of the diamond thin film dynode 84. The embodiment of the imaging device utilizing the diamond transmission dynode described above and shown in FIG. 8 includes contacts connected to metallized layers on the input and output surfaces of the diamond layer so that a voltage gradient can be applied across the thickness of the diamond transmission dynode 84, as described above.

The spacing between the diamond layer entrance surface 86*a* and the photocathode 82 is preferably selected to be larger than the spacing between the photocathode and the input surface of a microchannel plate (MCP) in the known Generation III or Generation IV imaging tube to facilitate higher voltage bombardment of the diamond layer. The photoelectrons diffuse into the thin film diamond dynode and create a cascade of internally generated secondary electrons. The internally generated electrons traverse the diamond film and are emitted from the opposite surface 86*b*. The emitted electrons then accelerate toward the input side of an MCP electron multiplier 87. A second ceramic spacer 85*b* and a second metallic spacer 83*b* are disposed between the thin film dynode 84 and the MCP 87 to maintain appropriate spacing therebetween.

The imaging device shown in FIG. 8 further includes a conventional arrangement of MCP 87 and a proximity lens 88 which provides sufficient acceleration of electrons to impinge upon a phosphor screen 89. The phosphor screen provides light emission and amplification of the incident electrons. A metallic spacer 83*c* and ceramic spacer 85*c* are disposed between the exit side of MCP 87 and the phosphor screen to maintain an appropriate spacing therebetween. A metallic bracket 91 supports the phosphor screen 89 in position. The MCP 87 could be replaced with two or more MCP's in tandem to provide additional electron gain.

In the imaging device shown in FIG. 8, an indium insert can be used between the metallic spacer 83*a* and the photocathode 82. Also, it is contemplated that glass spacers can be used in place of ceramic spacers 85*a,* 85*b,* and 85*c*.

Multi-Anode Photomultiplier Tube

Figure 9:
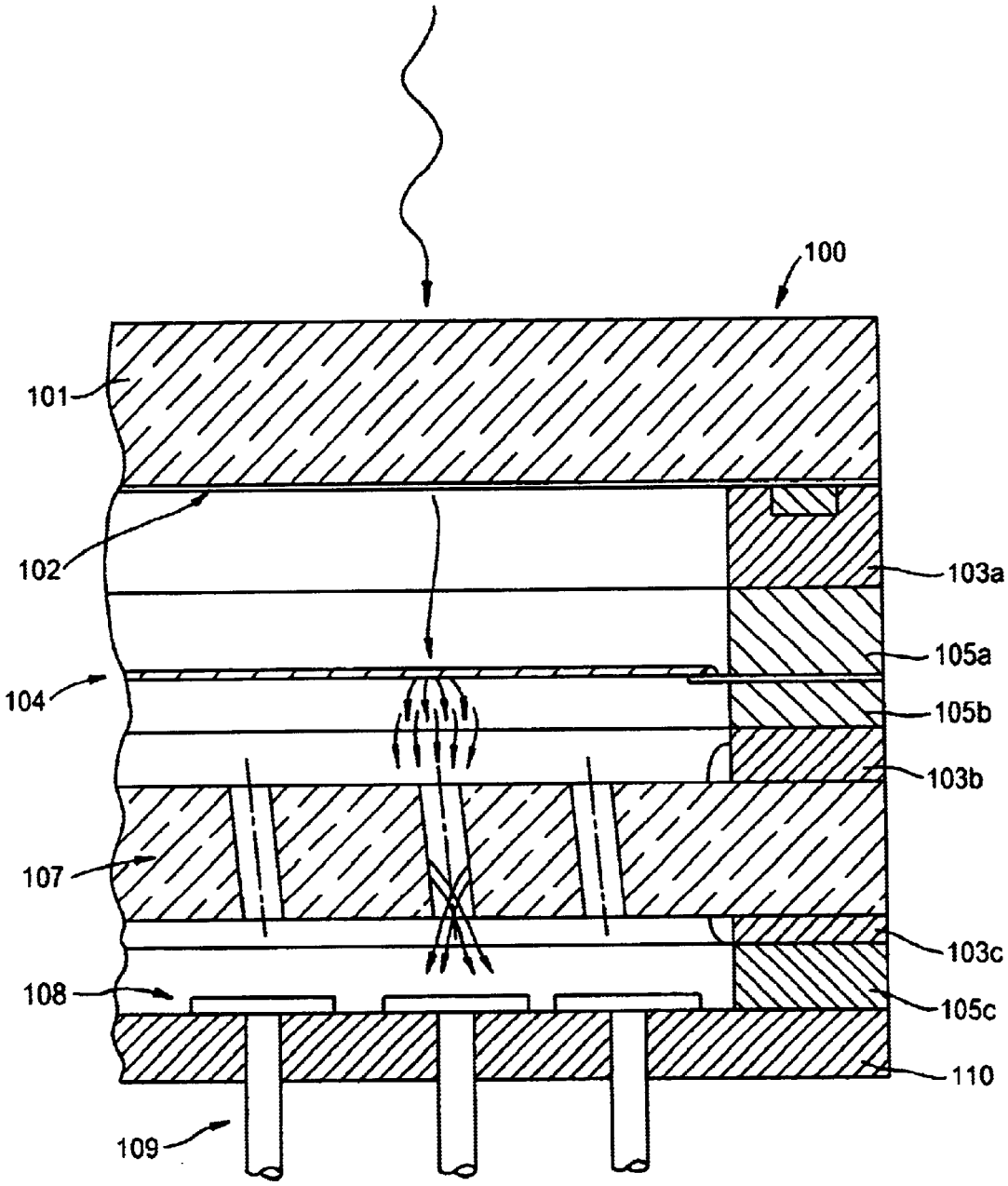
FIG. 9 is a partial cross-sectional view of a multi-anode photomultiplier in accordance with the present invention.

Referring now to FIG. 9, there is shown, in partial cross section, a photomultiplier tube 100 in accordance with another aspect of the present invention. The photomultiplier 100 includes a glass face plate 101, and a photocathode 102 formed on a surface of the face plate 101 and spaced a small distance from a TSE diamond thin film dynode 104. A metallic spacer 103*a* and a ceramic spacer 105*a* are disposed between the photocathode 102 and the diamond film dynode 104. A second ceramic spacer 105*b* and a second metallic spacer 103*b* are disposed between the thin film dynode 104 and an MCP 107 to maintain appropriate spacing therebetween. The arrangement of the elements in the photomultiplier 100 and the relative spacings between the various components from photocathode 102 to the output side of MCP 107 through the anode 109 are substantially identical to those for the imaging device described above. The most significant difference between the photomultiplier shown in FIG. 9 and the imaging device shown in FIG. 8 is the anode 109 which replaces the phosphor screen 89 in the imaging device. The anode 109 is preferably formed from a plurality of metal pads 108 which are in effect discrete anodes. The size of the metal pads controls the pixel size output provided by the device. The spacings between the components can be adjusted as necessary to be compatible with the pixel size defined by the anode spacing.

The metal pads represent the simplest anode readout element one can utilize in this structure. Other arrangements of anode readout known in the art may also be used, for example, a resistively patterned x-y addressable array. It is also contemplated to use any number of solid state readout sensors such as an electron sensitive diode array, etc. The MCP 107 could be replaced with two or more MCP's in tandem to give additional electron gain.

The diamond film transmission dynode 104 is shown as being a simple thin, diffusion layer in the embodiment shown in FIG. 9. The thicker, textured diamond transmission dynode described above is preferred for the non-imaging, defined pixel, multi-anode PMT according to this aspect of the present invention. The embodiment of the multi-anode PMT utilizing the diamond transmission dynode described above and shown in FIG. 9 includes contacts connected to thin metallized layers on the input and output surfaces of the diamond layer so that a voltage gradient can be applied across the thickness of the diamond transmission dynode 104, as described above.

The imaging device and the photomultiplier tube described above and shown in FIGS. 8 and 9, respectively, can be constructed using two or more of the thin film dynodes according to this invention arranged in a stacked or tandem configuration. In such an arrangement, the thin film dynodes are arrayed serially and spaced appropriately. In a photomultiplier using a stacked thin film dynode arrangement, the spacing is selected such that the required acceleration voltage can be applied without increasing the dark noise that results from field emission or other breakdown effects which increase the dark current of the tube. When a stacked dynode arrangement is used in an imaging device, the selection of the gap spacing between dynodes is also influenced by the desired pixel resolution.

Among the advantages of the imaging device or photomultiplier tube in accordance with the present invention is the realization of a significant improvement in the noise factor relative to known devices employing microchannel plates. The noise factor of an intensifying device is defined as the ratio of the signal to noise at the device input to that at its output. (It is necessarily greater than about 1, by definition.) The data in Table I below show, that the noise factor of a Generation II intensifier is in the range of 1.5 to 1.7, whereas the Generation III intensifier has a noise factor in the range of 1.9 to 2.1. The photomultiplier device according to the present invention is expected to have a noise factor less than about 1.2, which is comparable to the noise factor of a well-designed conventional discrete dynode photomultiplier. It will be noted further that the structures described above with reference to FIGS. 8 and 9 containing the diamond film dynode facing the photocathode at its entrance surface, and facing the MCP at its exit surface, with specified spacing, and voltages applied in those regions, has a modulation transfer function, and limiting resolution, which is nearly equal to a device utilizing only an MCP. Thus, a PMT in accordance with the present invention provides superior noise factor relative to the known devices which do not include a thin film diamond dynode without significant loss of resolving power. The description of the noise factor equations, along with the assumptions used in the derivations follows. The theoretical calculations are based on models by Pollehn, et al. and Bell, along with the general noise-in-signal equation for coupled signal and noise sources. We have generalized the results to include a broader class of statistics (Polya Statistics), but have not used non-zero Polya parameters in the table calculations.

The standard MCP intensifier noise chain contains the following elements:

a. The light source that is assumed to be Poisson;

b. A photocathode that has a mean quantum efficiency $\eta$; and c. An MCP, which has an effective, first strike gain of $\lambda$, which is assumed to obey Polya statistics with parameter $b_2$.

The noise factor of a 'film less' (Generation II or Generation IV) MCP intensifier is given by Equation (2) below.

$$N_f = \frac{1}{\sqrt{\theta}} \cdot \left(1 + b_2 + \frac{1 + b_3}{\lambda} + \frac{\theta}{G_{MCP}}\right)^{\frac{1}{2}} \tag{2}$$

where, $\theta$=The collection efficiency of the MCP, which is approximately related to the geometry of the MCP pore diameter and pore pitch;

$\lambda$=The mean first strike secondary emission yield of the MCP;

$b_2$=The Polya parameter which defines the statistics of the first strike multiplication process;

G=the gain of the rest of the MCP beyond the so-called 'first strike'; and $b_3$=The Polya Parameter which defines the statistics of the gain process in the rest of the MCP, beyond the first strike.

Note that equation (2) can also be used to describe the noise factor of a known photomultiplier, with suitable choice of parameter values.

The noise chain of the diamond/MCP intensifier according to the present invention contains the following elements:

a. A light source assumed to be Poisson as above;

b. A photocathode having a mean quantum efficiency θ, as above;

c. A thin diamond layer in proximity to the MCP, but not necessarily in contact with it; and d. An MCP, which has an effective, first strike gain of λ, which is assumed to obey Polya statistics with parameter $b_2$.

The noise factor for the diamond MCP intensifier according to the present invention is given by Equation (3) below.

$$N_f = \left(1 + b_1 + \frac{1+b_2}{\delta\theta} + \frac{1+b_3}{\delta\theta\lambda} + \frac{1}{G_{DMCP}}\right)^{\frac{1}{2}} \quad (3)$$

Note that this equation can also describe the Generation III intensifier noise chain with suitable choice of parameter values. The important point for the purpose of the present discussion is that the form of equations (2) and (3) is quite different, especially with regard to the appearance of the collection efficiency (θ) of the MCP. It appears that the collection efficiency is far more influential in the case of equation (2) (for the Generation II or Generation IV intensifiers) than it is with the diamond/MCP intensifier according to the present invention. This is a distinct advantage of the device made in accordance with the present invention. The calculated noise factors (F) for the Generation II, Generation III, Generation IV, the so-called "Standard" PMT, and a diamond/MCP device according to the present invention are given in Table I. The collection efficiency of the MCP may be estimated from Equation (4) below.

$$\theta = \frac{\pi\left(\frac{d}{c}\right)^2}{2\sqrt{3}} \quad (4)$$

where d=the pore diameter and c=center-to-center spacing in a close packed hex stacked channel arrangement.

TABLE I

Noise Factor Comparisons of Different Imaging Multipliers

| Type | θ | b1 | b2 | b3 | G | δ | λ | F |
|---|---|---|---|---|---|---|---|---|
| Gen II | 0.7 | | 0 | 1 | 1000 | | 2.5 | 1.60 |
| Gen III | 0.6 | 0 | 0 | 1 | 1000 | 1 | 2 | 2.08 |
| Gen IV | 0.7 | | 0 | 1 | 1000 | | 2.5 | 1.60 |
| DMCP | 0.7 | 0 | 0 | 1 | 12000 | 12 | 2.5 | 1.10 |
| Std. PMT | 0.85 | | 0 | 0 | 5.00E+05 | | 12 | 1.13 |

Note:
θ's are estimated. The filmed MCP (Gen. III) has a θ value closer to Geometrical OAR of 51%.

A mathematical model of the modulation transfer function (MTF) for the known imaging devices (Generation II or Generation IV) was calculated. The limiting resolution for the diamond dynode/MCP (DMCP) device according to the present invention was also calculated with the assumption that the extra proximity spacing between the photocathode and the input surface of the TSE diamond layer would add another resolving aperture limitation and could lead to resolution and MTF loss. In this case low-light level performance, as exemplified by better signal to noise ratio, or noise factor, was expected to be offset by reduced high light level resolution and improved picture quality. Our calculations show, however, that the tradeoff, for the parameters chosen is extremely modest, with less than 1 lp/mm limiting resolution loss calculated by the Method of Gaussian Apertures or determined from the 3% overall MTF frequency. To prevent significant MTF loss which would otherwise occur at high incident surface reflection secondary emission (RSE), the input surface of the diamond TSE film is preferably processed to minimize RSE, as described above. The various MTF limiting apertures in the imaging chain for the "standard" MCP intensifier are as follows.

1. GaAs Photocathode MTF: Modeled using xK1(x) Lambertian emission of photoelectrons, straight line travel through the semiconductor (a conservative loss model). The GaAs thickness is assumed to be about 2 μm (microns).
2. Proximity MTF from GaAs to MCP: This was calculated based on Csorba's Gaussian MTR expression and a value of 0.0139 eV emission energy as given by Fisher and Martinelli. The spacing is assumed to be 0.124 mm, and the voltage between photocathode and MCP input is assumed equal to 200 V.
3. The MCP MTF was calculated from the optimistic sampling function limit based on an MCP center-to-center spacing of about 6 microns.
4. MCP to Phosphor Screen proximity MTF. Again Csorba's Gaussian MTF expression is used with the spacing between MCP output and phosphor screen assumed to be 1 mm, with an applied voltage of 5.5 kV, and a mean emission energy of 0.08 eV from the MCP.
5. The phosphor screen MTF is derived from a mean particle size of 3 microns and to follow an $xK_1(x)$ functional form as above.
6. The final aperture MTF is calculated based on an assumed fiber optic plate with sampling limit of 3 microns.

The DMCP uses many of the same elements as the Standard MCP intensifier described above, except for the space added between the photocathode and diamond layer surface. The objective here is to increase that spacing as much as possible consistent with minimum MTF loss. The increased spacing is necessary to allow a substantial voltage to be applied between photocathode and diamond layer input surface so that the transmission secondary emission may be as large as desired without incurring undesirable noise, or field emission, arc-over phenomena in vacuum. The MTF limiting apertures in the imaging chain for the DMCP intensifier according to the present invention are as follows.

1. GaAs Photocathode-same as 1. above for the MCP.
2. Proximity MTF-Photocathode to Diamond Layer input surface. The mean emission energy is 0.0139 eV as above. The spacing is assumed to be about 0.8 mm, and the impressed voltage is assumed at 3.5 kV.
3. Diamond Layer MTF-$xK_1(x)$ functional form assumed with Diamond Layer thickness equal to 1 micron.
4. Diamond layer output surface to MCP input MTF is based on spacing and voltage identical to item 2. above for the "Standard MCP" intensifier. The mean emission energy is assumed to be 0.15 eV, which is a conservative value.
5. MCP MTF-identical to "Standard"MCP Intensifier (item 3.) above.
6. MCP Output to Phosphor Screen MTF is identical to "Standard" MCP Intensifier (item 4.) above.
7. Phosphor Screen MTF-identical to "Standard" MCP Intensifier (item 5.) above.
8. Fiber Optic Output Plate-identical to "Standard" MCP Intensifier (item 6.) above.

Table II shows the calculated MTF's for both the known intensifier structure (Generation IV) and the diamond MCP (DMCP) structure according to the present invention. The calculated limiting resolutions using the Method of Gaussian Apertures are also shown in the table.

TABLE II

MTF and Limiting Resolution Comparison

| (Hz) f (cycles/mm | Rlim(lp/mm) 61.5 GenIV Imager | Rlim(lp/mm) 60.7 DMCP Imager |
|---|---|---|
| 0 | 100.0% | 100.0% |
| 2.5 | 97.5% | 97.1% |
| 5 | 94.0% | 92.8% |
| 7.5 | 89.8% | 87.8% |
| 15 | 75.0% | 70.1% |
| 22.5 | 58.9% | 51.7% |
| 30 | 43.7% | 35.3% |
| 35 | 34.6% | 26.2% |
| 40 | 26.6% | 18.7% |
| 42.5 | 23.0% | 15.6% |
| 45 | 19.8% | 12.8% |
| 47.5 | 16.9% | 10.5% |
| 50 | 14.3% | 8.5% |
| 52.5 | 11.9% | 6.7% |
| 55 | 9.9% | 5.3% |
| 57.5 | 8.1% | 4.1% |
| 60 | 6.5% | 3.1% |

Figure 10:
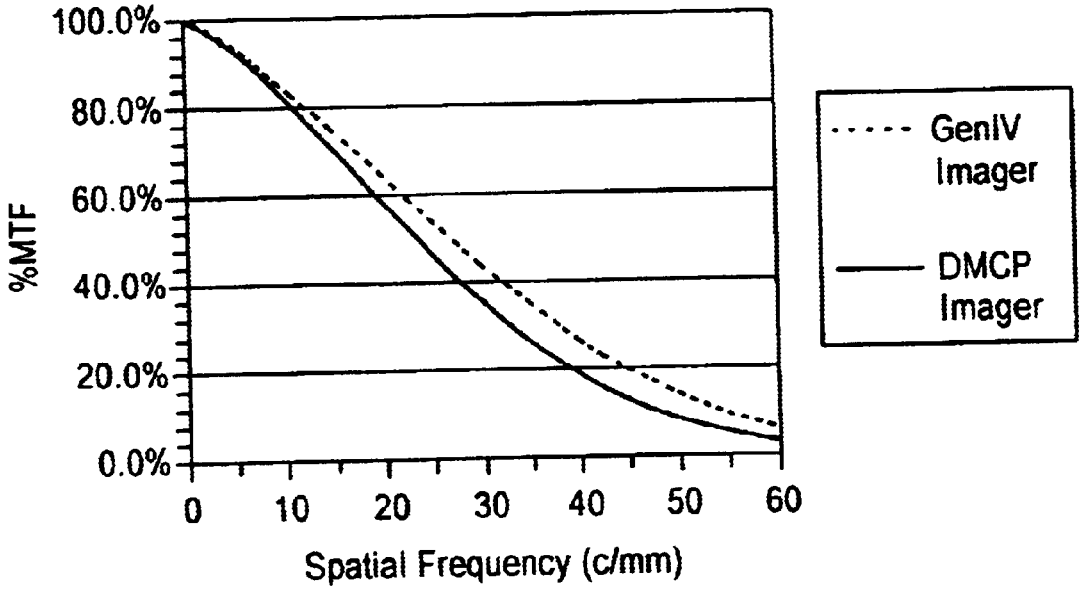
FIG. 10 is a graph of the data presented in Table II hereinbelow.

The results suggest that the model MTF's are mainly Gaussian in form, although the individual elements certainly are not all Gaussian. The calculated results are shown graphically in FIG. 10.

Clearly, the results show that the diamond TSE layer may be used in a proximity focused structure without a substantial loss of MTF or limiting resolution. The design calculations contained in Table II may also be used to place bounds on the separation between proximity sections related to the diamond layer, for achievement of optimum noise factor with minimum loss of MTF.

It will be recognized by those skilled in the art that changes or modifications may be made to the above-described invention without departing from the broad inventive concepts of this invention. It is understood, therefore, that the invention is not limited to the particular embodiments disclosed herein, but is intended to cover all modifications and changes which are within the scope of the invention as defined in the appended claims.

What is claimed is:

1. An electron multiplying transmission dynode for a photoelectronic device consisting essentially of:

a layer of crystalline semiconductive material having an input surface and an output surface, a first ohmic metallic electrode formed on the input surface of said semiconductive layer, said first ohmic metallic electrode being substantially coextensive with the input surface;

a second ohmic metallic electrode formed on the output surface of said semiconductive layer said second ohmic metallic electrode being substantially coextensive with the output surface; and means connected to said first and second ohmic metallic electrodes for applying a bias potential between said first and second ohmic metallic electrodes.

2. A dynode as set forth in claim 1 wherein the semiconductive material is selected from the group consisting of polycrystalline diamond, CaF, MgO, AlN, BN, GaN, InN, SiC, and nitride alloys containing two or more of Al, B, Ga, and In.

3. A dynode as set forth in claim 1 or 2 wherein the semiconductive material is textured with a (100) orientation.

4. A dynode as set forth in claim 3 wherein the first and second metallic electrodes are in the form of a grid.

5. A dynode as set forth in claim 3 wherein the first metallic electrode is a continuous thin metallic layer.

6. A dynode as set forth in claim 5 wherein the second metallic electrode is in the form of a grid.

7. A dynode as set forth in claim 1 wherein the semiconductive material is selected from the group consisting of monocrystalline diamond, CaF, MgO, AlN, BN, GaN, InN, SiC, and nitride alloys containing two or more of Al, B, Ga, and In.

8. A dynode as set forth in claim 7 wherein the first and second metallic electrodes are in the form of a grid.

9. A dynode as set forth in claim 7 wherein the first metallic electrode is a continuous thin metallic layer.

10. A dynode as set forth in claim 9 wherein the second metallic electrode is in the form of a grid.

11. An optical imaging device comprising:

a photocathode;

an electron multiplying transmission dynode consisting essentially of a layer of crystalline semiconductive material having an input surface an output surface, a first ohmic metallic electrode formed on the input surface of said semiconductive layer, said first ohmic metallic electrode being substantially coextensive with the input surface, and a second ohmic metallic electrode formed on the output surface of said semiconductive layer said second ohmic metallic electrode being substantially coextensive with the output surface, said electron multiplying transmission dynode being disposed for receiving electrons from said photocathode at the input surface;

a source of electric potential operatively connected to the first and second metallic electrodes for providing a bias potential therebetween;

means for spacing said electron multiplying transmission dynode from said photocathode;

a phosphor screen disposed for receiving electrons emitted from the output surface of said electron multiplying transmission dynode; and means for spacing said phosphor screen from the output surface.

12. An optical imaging device as set forth in claim 11 further comprising:

a microchannel plate disposed between said electron multiplying transmission dynode and said phosphor screen for multiplying electrons received from the output surface of said electron multiplying transmission dynode; and means for spacing said microchannel plate from the output surface of said electron multiplying transmission dynode.

13. An optical imaging device as set forth in claim 11 wherein the semiconductive material is selected from the group consisting of polycrystalline diamond, CaF, MgO, AlN, BN, GaN, InN, SiC, and nitride alloys containing two or more of Al, B, Ga, and In.

14. An optical imaging device as set forth in any of claim 11, 12, or 13 wherein the semiconductive material is textured with a (100) orientation.

15. An optical imaging device as set forth in claim 14 wherein the first and second metallic electrodes are in the form of a grid.

16. An optical imaging device as set forth in claim 14 wherein the first metallic electrode is a continuous thin metallic layer.

17. An optical imaging device as set forth in claim 16 wherein the second metallic electrode is in the form of a grid.

18. An optical imaging device as set forth in claim 11, 12, or 13 further comprising a second electron multiplying transmission dynode having a thin layer of the crystalline semiconductive material, an input surface, an output surface, a first ohmic metallic electrode formed on the input surface, said first ohmic metallic electrode being substantially coextensive with the input surface, and a second ohmic metallic electrode formed on the output surface, said second ohmic metallic electrode being substantially coextensive with the output surface, said second electron multiplying transmission dynode being disposed for receiving electrons from said electron multiplying transmission dynode.

19. An optical imaging device as set forth in claim 18 wherein the semiconductive material is textured with a (100) orientation.

20. An optical imaging device as set forth in claim 11, 12, or 13 further comprising a plurality of electron multiplying transmission dynodes each having a thin layer of the crystalline semiconductive material, an input surface, an output surface, a first ohmic metallic electrode formed on the input surface, said first ohmic metallic electrode being substantially coextensive with the input surface, and a second ohmic metallic electrode formed on the output surface, said second ohmic metallic electrode being substantially coextensive with the output surface, said plurality of electron multiplying transmission dynodes being disposed between said electron multiplying transmission dynode and said phosphor screen, and being spaced from each other and from said electron multiplying transmission dynode.

21. An optical imaging device as set forth in claim 20 wherein the semiconductive material is textured with a (100) orientation.

22. An optical imaging device set forth in claim 11 wherein the semiconductive material is selected from the group consisting of monocrystalline diamond, CaF, MgO, AlN, BN, GaN, InN, SiC, and nitride alloys containing two or more of Al, B, Ga, and In.

23. An optical imaging device as set forth in claim 22 wherein the first and second metallic electrodes are in the form of a grid.

24. An optical imaging device as set forth in claim 22 wherein the first metallic electrode is a continuous thin metallic layer.

25. An optical imaging device as set forth in claim 24 wherein the second metallic electrode is in the form of a grid.

26. A photomultiplier comprising:

a photocathode;

an electron multiplying transmission dynode having a thin layer of a semiconductive material, an input surface, an output surface, a first metallic electrode formed on the input surface, and a second metallic electrode formed on the output surface, said electron multiplying transmission dynode being disposed for receiving electrons from said photocathode at the input surface;

a source of electric potential operatively connected to the first and second metallic electrodes;

means for spacing said electron multiplying transmission dynode from said photocathode;

an anode disposed for receiving electrons emitted from said electron multiplying transmission dynode; and means for spacing said anode from said electron multiplying transmission dynode.

27. A photomultiplier as set forth in claim 26 further comprising:

a microchannel plate disposed between said electron multiplying transmission dynode and said anode for multiplying electrons received from the output surface of said electron multiplying transmission dynode; and means for spacing said microchannel plate from the output surface of said electron multiplying transmission dynode.

28. A photomultiplier as set forth in claim 26 wherein the semiconductive material has a crystalline structure.

29. A photomultiplier as set forth in claim 26 wherein the semiconductive material is selected from the group consisting of polycrystalline diamond, CaF, MgO, AlN, BN, GaN, InN, SiC, and nitride alloys containing two or more of Al, B, Ga, and In.

30. A photomultiplier as set forth in any of claims 26, 27, 28, or 29 wherein the semiconductive material is textured with a (100) orientation.

31. A photomultiplier as set forth in claim 30 wherein the first and second metallic electrodes are in the form of a grid.

32. A photomultiplier as set forth in claim 30 wherein the first metallic electrode is a continuous thin metallic layer.

33. A photomultiplier as set forth in claim 32 wherein the second metallic electrode is in the form of a grid.

34. A photomultiplier set forth in claim 26 wherein the semiconductive material is selected from the group consisting of monocrystalline diamond, CaF, MgO, AlN, BN, GaN, InN, SiC, and nitride alloys containing two or more of Al, B, Ga, and In.

35. A photomultiplier as set forth in claim 34 wherein the first and second metallic electrodes are in the form of a grid.

36. A photomultiplier as set forth in claim 34 wherein the first metallic electrode is a continuous thin metallic layer.

37. A photomultiplier as set forth in claim 36 wherein the second metallic electrode is in the form of a grid.

38. A photomultiplier as set forth in claim 26, 27, 28, or 29 further comprising a second electron multiplying transmission dynode having a thin layer of the crystalline semiconductive material, an input surface, an output surface, a first ohmic metallic electrode formed on the input surface, said first ohmic metallic electrode being substantially coextensive with the input surface, and a second ohmic metallic electrode formed on the output surface, said second ohmic metallic electrode being substantially coextensive with the output surface, said second electron multiplying transmission dynode being disposed for receiving electrons from said electron multiplying transmission dynode.

39. A photomultiplier as set forth in claim 38 wherein the semiconductive material is textured with a (100) orientation.

40. A photomultiplier as set forth in claim 26, 27, 28, or 29 further comprising a plurality of electron multiplying transmission dynodes each having a thin layer of the crystalline semiconductive material, an input surface, an output surface, a first ohmic metallic electrode formed on the input surface, said first ohmic metallic electrode being substantially coextensive with the input surface, and a second ohmic metallic electrode formed on the output surface, said second ohmic metallic electrode being substantially coextensive with the output surface, said plurality of electron multiplying transmission dynodes being disposed between said electron multiplying transmission dynode and said anode, and being spaced from each other and from said electron multiplying transmission dynode.

41. A photomultiplier as set forth in claim 40 wherein the semiconductive material is textured with a (100) orientation.

42. A photomultiplier as set forth in claim 26 wherein the anode comprises a plurality of metal pads.

43. A photocathode for emitting photoelectrons in response to incident light consisting essentially of:

a layer of crystalline semiconductive material having an input surface and an output surface, a first ohmic metallic electrode formed on the input surface of said semiconductive layer, said first ohmic metallic electrode being substantially coextensive with the input surface;

a second ohmic metallic electrode formed on the output surface of said semiconductive layer said second ohmic metallic electrode being substantially coextensive with the output surface; and means connected to said first and second ohmic metallic electrodes for applying a bias potential between said first and second ohmic metallic electrodes.

44. A photocathode as set forth in claim 43 wherein the semiconductive material is selected from the group consisting of polycrystalline diamond, CaF, MgO, AlN, BN, GaN, InN, SIC, and nitride alloys containing two or more of Al, B, Ga, and In.

45. A photocathode as set forth in claim 43 or 44 wherein the semiconductive material is textured with a (100) orientation.

46. A photocathode as set forth in claim 45 wherein the first and second metallic electrodes are in the form of a grid.

47. A photocathode as set forth in claim 43 wherein the semiconductive material is selected from the group consisting of monocrystalline diamond, CaF, MgO, AlN, BN, GaN, InN, SiC, and nitride alloys containing two or more of Al, B, Ga, and In.

48. A photocathode as set forth in claim 47 wherein the first and second metallic electrodes are in the form of a grid.

* * * * *